US006801128B1

(12) United States Patent
Houston

(10) Patent No.: US 6,801,128 B1
(45) Date of Patent: Oct. 5, 2004

(54) PERIMETER BEAM TOWER

(76) Inventor: Robert B. Houston, 200 NE. 2nd Dr., Homestead, FL (US) 33030

( * ) Notice: Subject to any disclaimer, the term of this patent is extended or adjusted under 35 U.S.C. 154(b) by 0 days.

(21) Appl. No.: 09/956,558

(22) Filed: Sep. 20, 2001

Related U.S. Application Data

(60) Provisional application No. 60/234,227, filed on Sep. 21, 2000, and provisional application No. 60/234,310, filed on Sep. 21, 2000.

(51) Int. Cl.[7] ..... G08B 13/18

(52) U.S. Cl. ..... 340/556; 340/557; 340/693.5; 361/600; 248/637; 248/121; 248/127; 248/346.01

(58) Field of Search ..... 340/556, 557, 340/522, 693.5, 693.6, 693.9, 693.12; 361/600; 248/637, 121, 156, 127, 126, 346.01, 694, 917, 910, 904

(56) References Cited

U.S. PATENT DOCUMENTS 4,322,007 A * 3/1982 Feibelman ..... 211/163
4,691,892 A * 9/1987 Grewe et al. ..... 248/624
4,823,772 A * 4/1989 Lenz ..... 126/602
4,961,506 A * 10/1990 Lang ..... 211/188
4,978,942 A * 12/1990 Bruce ..... 340/556
5,167,436 A * 12/1992 Wu ..... 297/338
5,198,799 A * 3/1993 Pascale ..... 340/552
5,422,638 A * 6/1995 Singer et al. ..... 340/908.1
5,440,292 A * 8/1995 Bedrosian ..... 340/567
5,554,972 A * 9/1996 Byrne ..... 340/556
5,617,962 A * 4/1997 Chen ..... 211/206
5,622,078 A * 4/1997 Mattson ..... 74/89.23
5,820,086 A * 10/1998 Hoftman et al. ..... 248/125.2
5,875,578 A * 3/1999 Grewe ..... 40/608
5,893,541 A * 4/1999 Michaelson ..... 248/158
5,915,656 A * 6/1999 Grewe ..... 248/150
5,957,417 A * 9/1999 Yu ..... 248/166
6,004,002 A * 12/1999 Giannone ..... 362/183
6,007,032 A * 12/1999 Kuo ..... 248/185.1
6,061,245 A * 5/2000 Ingraham et al. ..... 361/749
6,114,963 A * 9/2000 Blake et al. ..... 340/573.4
6,118,375 A * 9/2000 Duncan ..... 340/541

* cited by examiner

*Primary Examiner*—Benjamin C. Lee
(74) *Attorney, Agent, or Firm*—Krieg DeVault Lundy LLP

(57) ABSTRACT

A security system employs a plurality of towers for detecting an intruder. A detection beam extends between adjacent towers, and a breach in the detection beam detects the presence of intruders. The solar tower includes a solar panel, a solar mounting bracket, a swivel clamp, a swivel solar bracket, a solar cap opening mechanism, a solar base cap, and a top plate. The solar tower further includes a base unit, frame support rods extending from the base unit, a frame unit having face shield slots, and opposing face shields mounted in the face shield slots. The top plate is secured to the frame support rods with suitable fasteners.

20 Claims, 12 Drawing Sheets

POINT TO POINT SINGLE QUAD BEAM
MAXIMUM DISTANCE 660 FEET FROM TOWER TO TOWER

POINT TO POINT SINGLE DUAL BEAM
MAXIMUM DISTANCE 660 FEET FROM TOWER TO TOWER

HIGH/LOW – MAXIMUM DISTANCE 660 FEET FROM TOWER TO TOWER

HIGHEST LEVEL - MAXIMUM DISTANCE OF 450 FEET FROM TOWER TO TOWER

PERIMETER BEAM TOWER

This application claims priority of provisional patent application 60/234,227 filed Sep. 21, 2000, entitled: Solar Powered Perimeter Beam Tower, and provisional patent application 60/234,310 filed Sep. 21, 2000, entitled Solar Powered Perimeter Beam. Both provisional applications are now incorporated by reference herein.

FIELD OF THE INVENTION

The present invention relates to support towers for electronic and solar equipment. More particularly, the invention relates to a perimeter beam tower apparatus for an intruder detection system.

BACKGROUND OF THE INVENTION

There are many known types of towers. It is a problem in the art to house solar-powered radio equipment, and multiple beam generators for an intruder detection system.

U.S. Design Pat. No. Des. 341,221 to Elazari teaches a solar powered outdoor lamp. The lamp has a base and a support pole.

U.S. Pat. No. 4,281,369 to Batte teaches a method and apparatus for solar power lighting. It includes plural panels mounted atop a light pole with a support base.

U.S. Pat. No. 4,841,416 to Doss teaches a solar charging lamp. It includes a support post mounted atop a base and having a light globe on tom, and having solar panels attached to the pole.

U.S. Design Pat. No. Des. 353,014 to Elazari teaches a solar powered outdoor lamp. The lamp includes a globe mounted atop a pole, which in turn is mounted atop a base, and includes two solar panels mounted to the pole.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a secure and conveniently installable perimeter beam tower for an intruder detection system. The system may be remotely powered, or powered by a solar panel mounted upon the tower.

The security system employs multiple beam generators on the tower to generate multiple beams which extend to an adjacent tower. The security system includes a receiver/processor and transmitter for communicating with electronic devices between the perimeter beam towers and a remote processing central unit. Each tower houses a receiver/processor and transmitting device having an antenna, a housing, and an indicator. The indicator includes information on the location of an intrusion.

A solar panel may be mounted to the perimeter beam tower to provide local power, eliminating the need to supply power from a remote source. When a solar panel is used, the solar panel is supported by mounting bracket, a swivel clamping bolt, a swivel bracket O-ring, a swivel solar bracket, a solar cap O-ring, a solar cap opening mechanism, a solar base cap, and a stainless steel top plate. The perimeter beam tower also includes frame support rods, a frame unit, a frame tower, face shields, a base unit, and face shield slots.

Other objects and advantages of the present invention will be more readily apparent from the following detailed description when read in conjunction with the accompanying drawings.

DETAILED DESCRIPTION OF THE INVENTION

Figure 1:
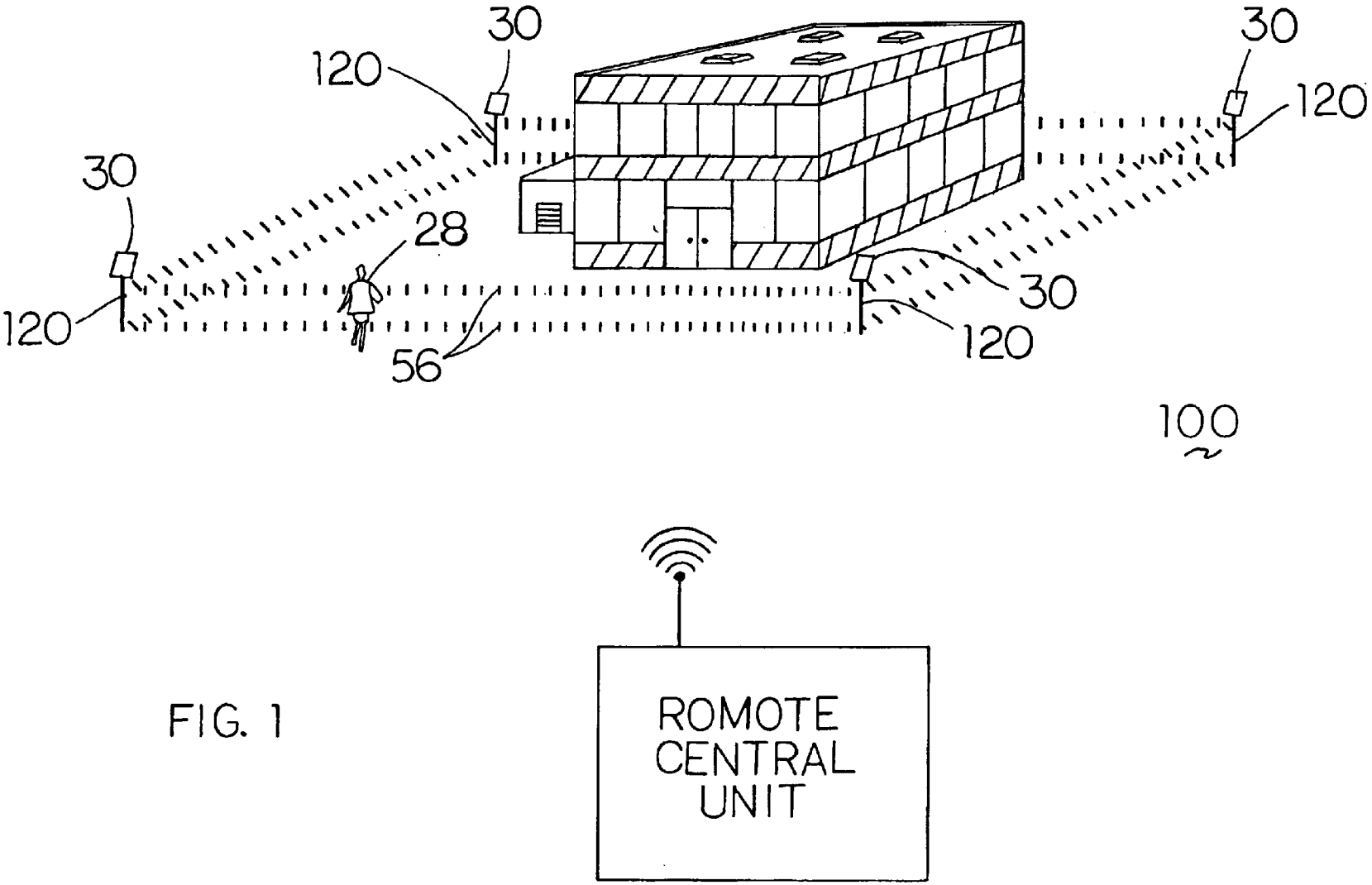
FIG. 1 is a perspective view illustrating a security system employing a plurality of perimeter beam towers, according to the present invention.

FIG. 1 is a perspective view illustrating a security system 100 employing a plurality of perimeter beam towers 120, for detecting an intruder 28. The security system 100 includes a receiver/processor and transmitter unit 20 in each tower 120 communicating with a remote central unit. The remote central unit is outfitted with various electronic devices that display various information, including information on the location of an intrusion. In the security system 100 of FIG. 1, multiple detection beams extending between adjacent towers 120 are used to detect intruders 28. The multiple detection beams may include an infrared beam, a laser beam, a microwave beam, a visible light beam, or any combination of detection beams.

The security system 100 is supervised-wireless perimeter security detection system for outdoor applications. The security system 100 provides easy deployment and installation. The perimeter beam towers 120 may be solar powered as disclosed herein, or may be remotely powered where a suitable source of electrical power is available.

At least one detection beam generator/detector 134 is provided on each tower 120 for generating and detecting multiple detection beams 56 extending between adjacent towers 120 in the system 100. The detection beams 56 extend between adjacent towers 120, and a breach in the detection beams 56 signals an alarm at either or both of the remote central unit and the towers 120 detecting the breach. A remote control master receiver is preferably used to communicate between perimeter beam towers 120. The remote control master receiver is preferably a radio communication system corresponding to the receiver/processor and transmitter unit 20 of FIG. 1.

Certain components of the perimeter beam tower 120, as will be clear as described below, are preferably constructed of a polycarbon composite fiber material. However, other suitable plastic or fiberglass materials, are also contemplated as being within the scope of the present invention.

Figure 2:
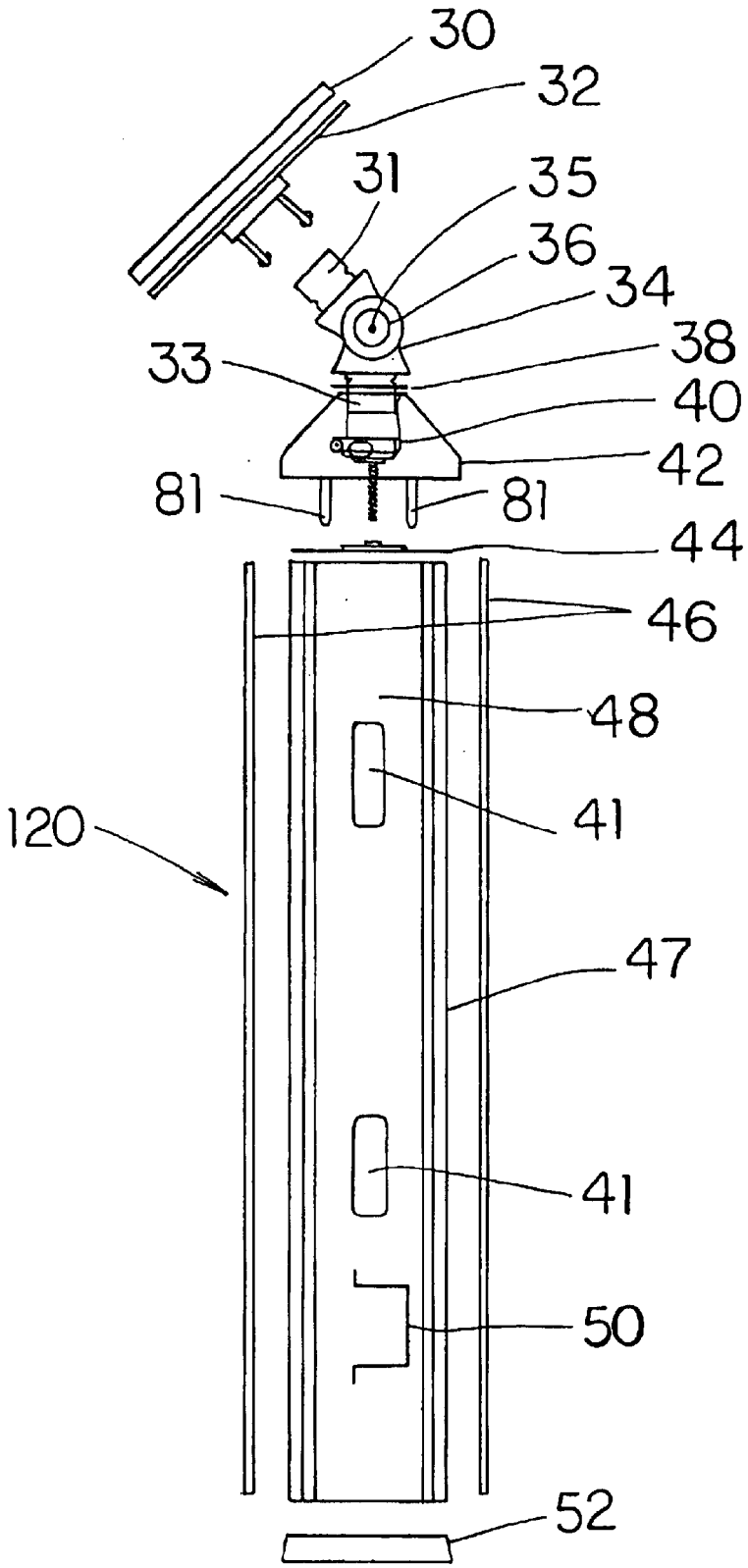
FIG. 2 is an assembly view of a solar powered perimeter beam tower according to the present invention.

FIG. 2 is an exploded assembly view of perimeter beam tower 120 powered by a solar panel 30. The tower 120 of FIG. 2 includes a solar panel 30, which is preferably a twenty watt solar panel 30 having a solar array 135 for collecting solar energy and generating electrical energy therefrom. A solar mounting bracket 32, which is preferably made of stainless steel, or other corrosion resistant materials, is used to secure the solar panel 30 to the upper portion 31 of a swivel clamp 34. The upper portion 31 of the swivel clamp 34 is adjustably secured to a lower portion 33 of the swivel clamp 34. The upper portion 31 and lower portion 33 of the swivel clamp 34 are adjustably secured together with a suitable fastening means, such as a bolt 35. A swivel O-ring 36 is positioned between the upper portion 31 and the lower portion 33 of the swivel clamp 34. The swivel clamp 34 allows the solar panel 30 to be positioned at different angles to better align the solar panel with the sun.

The perimeter beam tower may alternately be powered from a remote power supply source, such as 12 Volt, 120 Volt or 240 Volt electrical power, or from a solar panel positioned remotely from the tower 120 but electronically connected thereto.

The lower portion 33 of the swivel clamp 34 extends through a solar cap O-ring 38 into a swivel aperture 39 in the solar base cap 42. The solar base cap 42 is mounted upon a top plate 44. The solar base cap 42 has at least two alignment pins 81, and preferably four alignment pins 81, which are received in pin apertures 82 located in the top plate 44. The alignment pins 81 allow the solar cap 42 to move freely up and down.

A solar cap 42 opening mechanism 40 provides access into the interior of the tower 120. A power cable 60 extends from the solar panel 30 through the swivel clamp 34 and solar base cap 42, into the interior of the tower 120.

At least two support rods 46 are secured to the base unit 52, and extend up to the top plate 44. The support rods 46 are from five feet high to twelve feet high, and are preferably from six feet to eight feet high. The support rods 46 are preferably aluminum rods. The frame unit 47 slides over the support rods 46, where the frame unit 47 is secured to the base unit 52. The frame unit 47 is preferably of a height similar to the height of the support rods 46. At least one face 48 is provided on the frame unit 47 that is configured for having various electrical equipment mounted thereto for the operation of the system 100, including a beam generator/detector 134, the receiver/processor and transmitter unit 20 and power source components such as rechargeable batteries and voltage regulators. Open channels 41 are provided inside the frame unit 47 to allow for the power cable 60 wiring from the equipment mounted on the face 48 of the solar tower 120 to extend through the open channels 41 in the frame unit 47 to the base unit 52.

Opposing face shields 49 are preferably shaped in a half oval configuration, similar to a U-shaped design. The face shields 49 are preferably made of a polycarbon plastic material. The face shields 49 are preferably of a height similar to the height of the support rods 46.

The face shields 49 have edges 90 that are inserted into the face shield slots 58 located on the frame unit 47. A suitable fastening means 54 secures the top plate 44 and the frame unit 47 to the support rods 46.

The base unit 52 is preferably an oval shaped polycarbon molded unit, which is secured to the ground, or to a suitable foundation such as a concrete footing (not shown).

A stainless steel solar mounting bracket 32 is mounted to the top of the swivel clamp 34. A solar array panel 30 is mounted upon the solar mounting bracket 32. A power cable 60 from the solar array panel 30 passes through the center of the solar mounting bracket 32 into the upper portion 31 of the swivel clamp 34 through to the lower portion 33, into aperture 39 of the solar base cap 42 and extending into the frame unit 47 through channels 41 at the top of the frame unit 47.

The swivel clamp 34 is preferably a two-piece polycarbon swivel clamp that clamps together to allow the solar array panel 30 to the positioned at different angles for optimal alignment with the sun. The upper portion 31 of the swivel clamp 34 attaches to the solar mounting bracket 32 and the lower portion 33 of the swivel clamp 34 is inserted inside the swivel aperture 39 in the top portion of the solar base cap 42.

The solar base cap 42 and the solar cap opening mechanism 40 (located inside the housing of the cap 42) permits access into the tower 120. A special key (not shown) may be used, for example, to raise and lower the solar cap 42, using a drill or a screw-type shaft positioned in the center of the solar cap 42. Four alignment pegs 81 allow the solar cap 42 to move freely up and down. A recessed opening 39 in the solar cap 42 allows the lower portion 33 of the swivel clamp 34 to be inserted along with a power wire 60. A suitable fastening means 54 is used to clamp together the top plate 44, the support rods 46, and the frame unit 47.

The frame unit 47 has a main body which slides over the frame support rods 46 and attaches to the base unit 52 with a fastening means 54. The top plate 44 bolts to the support rods 46, giving all three components the strength needed. Open channels 41 inside the frame unit 47 allow for the power cable 60 wiring to be installed. An optional battery clamp 50 may be secured to the face 48 of the frame unit 47 to support one or more batteries 51 within the frame unit 47.

The base unit 52 is preferably an oval-shaped polycarbon member which is about eight inches wide, twelve inches long, and two inches high. The base unit 52 is used to secure the perimeter beam tower 120 to the ground. In addition, the base unit 52 is secured with fastening means 54 to the support rods 46 to clamp the frame unit 47 together.

Each face shield 49 is from four to eight inches wide and substantially the height of the frame support rods 46. The face shields 49 are inserted into the base unit 52 first. Then, the face shields 49 are inserted into channels provided in the frame unit 47.

Figure 3:
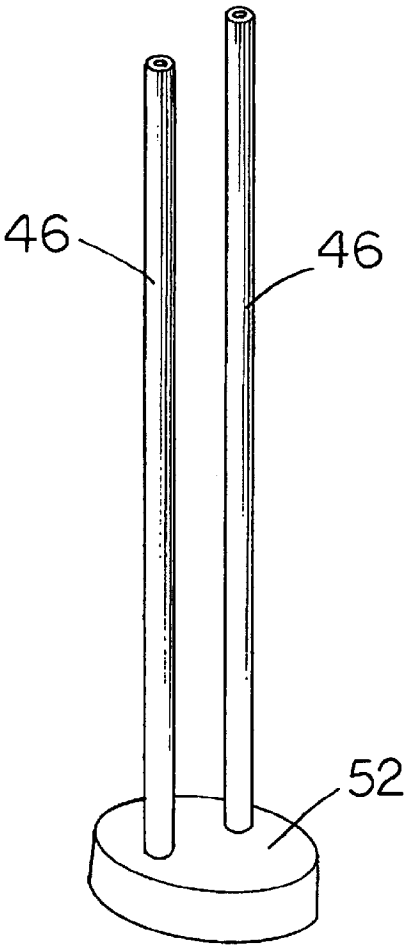
FIG. 3 is a perspective view of a tower housing base unit with support rods extending from the base unit.

FIG. 3 is an elevation view of the frame support rods 46 secured into the base unit 52.

Figure 4:
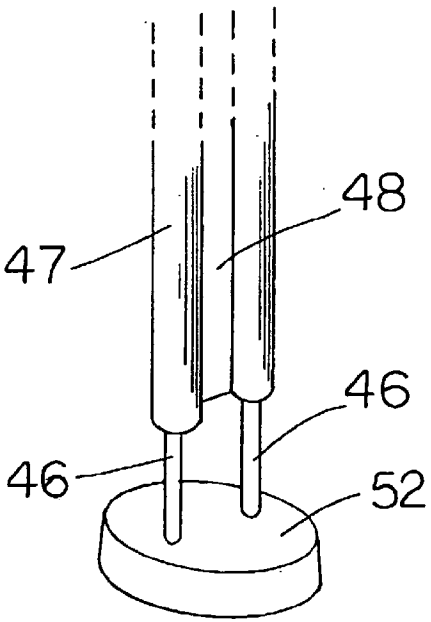
FIG. 4 is a partial perspective view of a tower housing base unit, support rods, and frame unit.

FIG. 4 is a perspective view of the support rods 46, and the frame unit 47 secured to the base unit 52.

Figure 5:
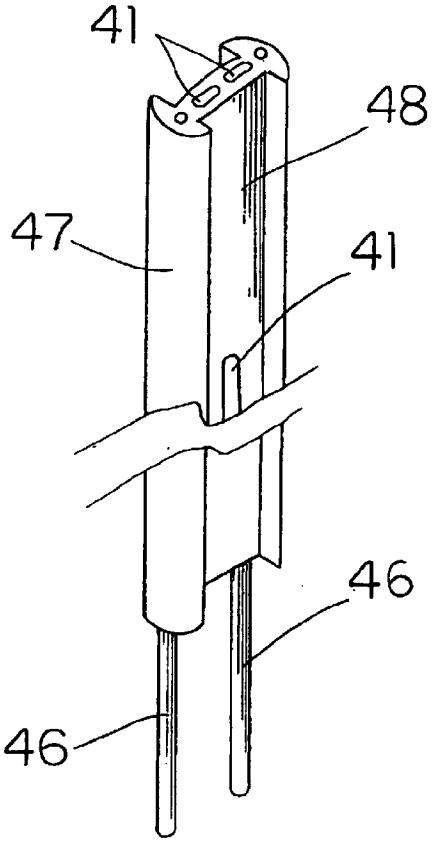
FIG. 5 is a perspective view of a tower housing frame unit inserted over support rods.

FIG. 5 is a perspective view of a beam housing frame unit 47 being installed over the support rods 46.

Figure 6:
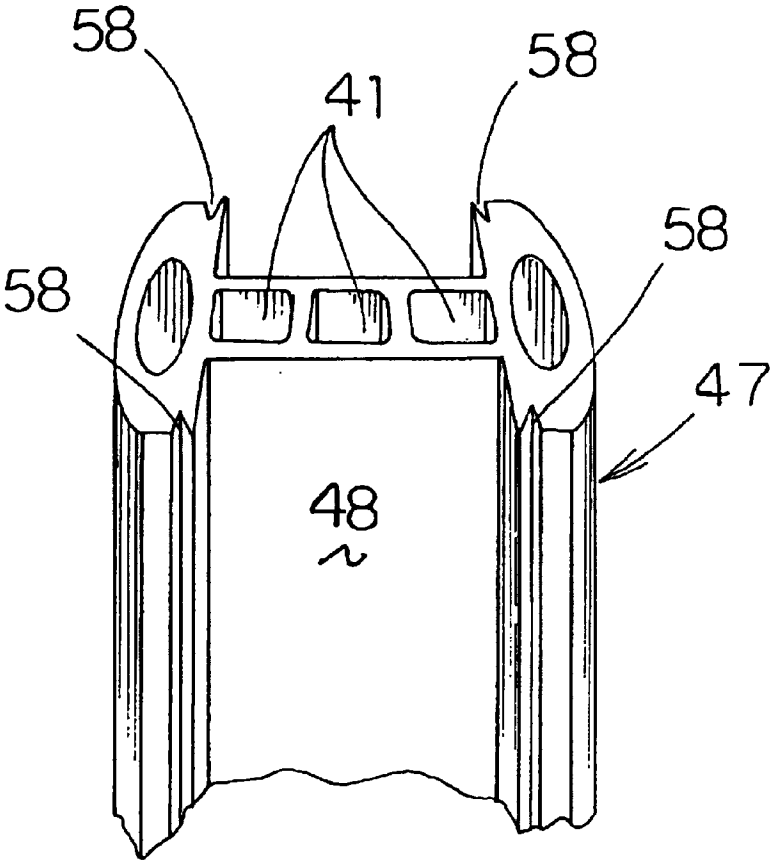
FIG. 6 is a perspective view of a top view the tower frame unit, prior to installation.

FIG. 6 is a top view in perspective of the frame unit 47, having face shield slots 58 and open channels 41 extending the length of the frame unit 47.

Figure 7:
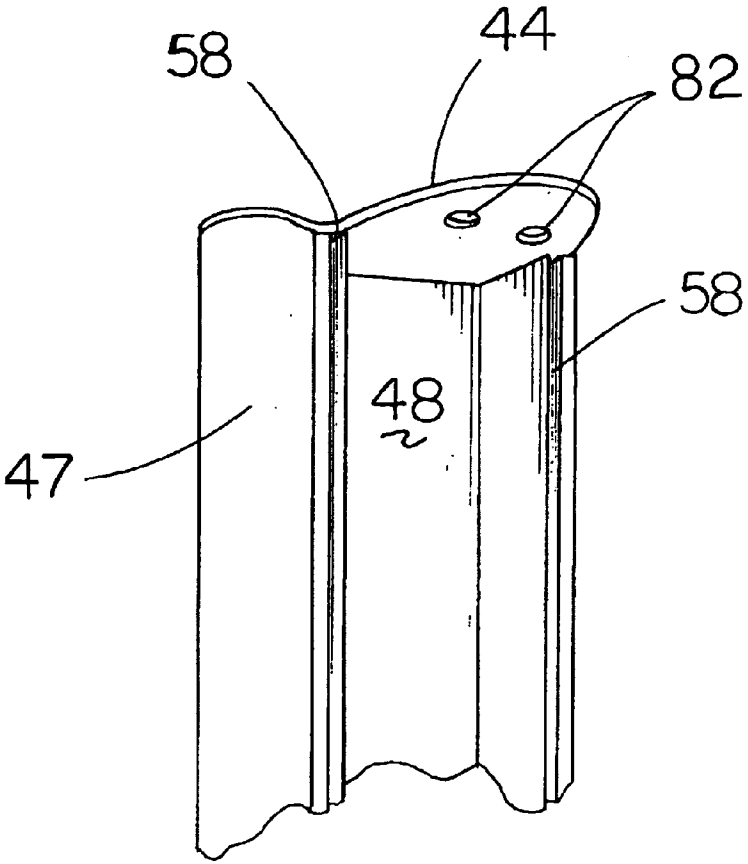
FIG. 7 is a perspective view of a clamping plate being installed upon the frame housing.

FIG. 7 is a perspective view of the beam housing clamping plate 44 being installed on top of the frame unit 47.

Figure 8:
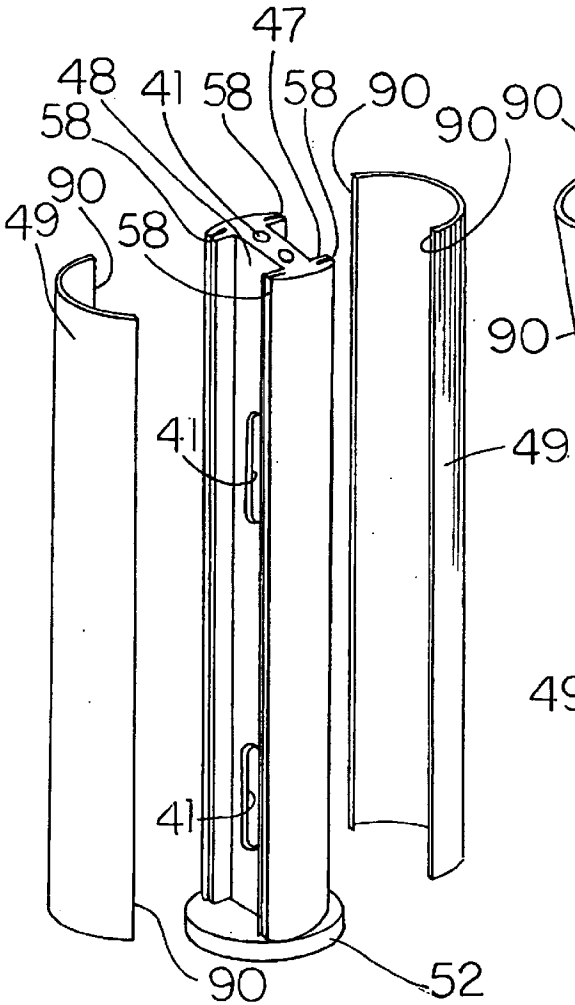
FIG. 8 is a perspective view of a perimeter beam tower during installation, showing a housing frame and opposing face shields.

FIG. 8 is a perspective view of the beam housing frame 47 with opposing face shields 49 prior to installation in the face shield slots 58.

Figure 10:
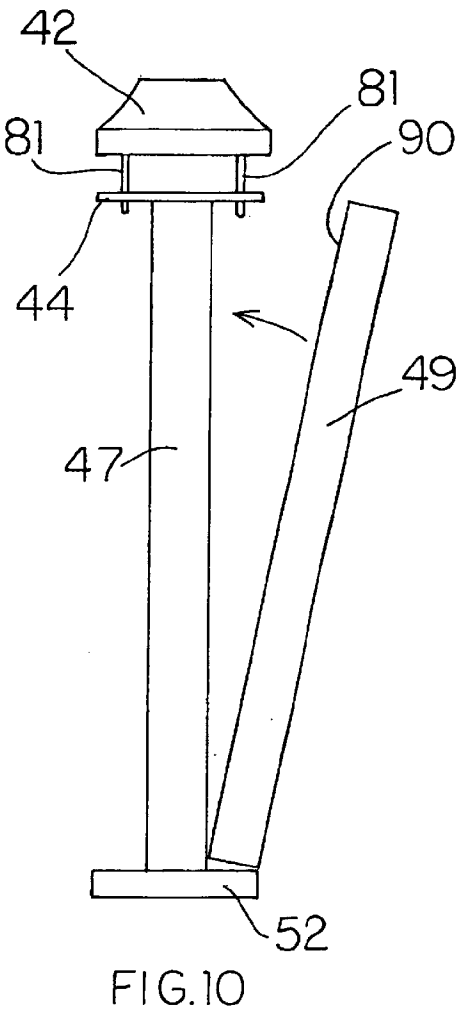
FIG. 10 is a perspective view of a perimeter beam tower showing a face shield installation (right side).
Figure 9:
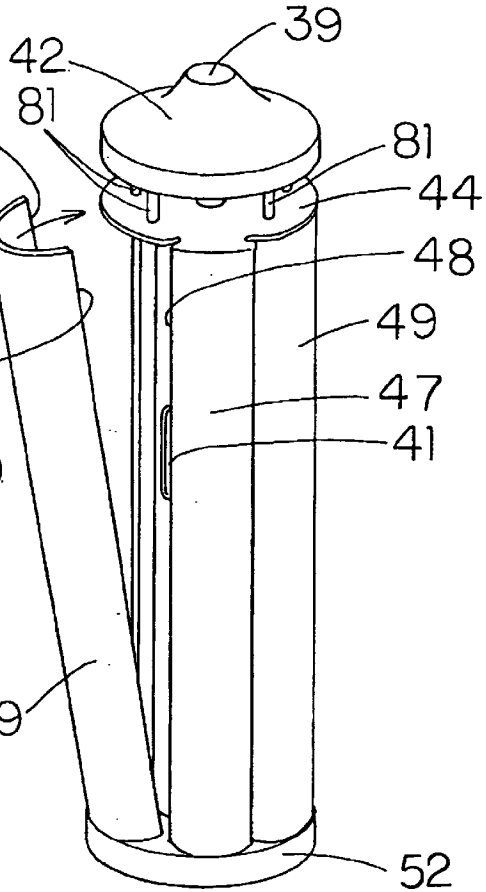
FIG. 9 is a perspective view of a face shield installation (left side), with a base cap positioned over alignment pins.

FIG. 9 is a perspective view of the face shield installation process, showing the face shield 49 on the right side installed, and the face shield 49 on the left side being installed. FIG. 10 is a perspective view of the face shield installation process of the face shield 49 on the right side of the figure. This view also shows the solar cap opening mechanism 40 atop the beam housing frame 47.

Figure 11:
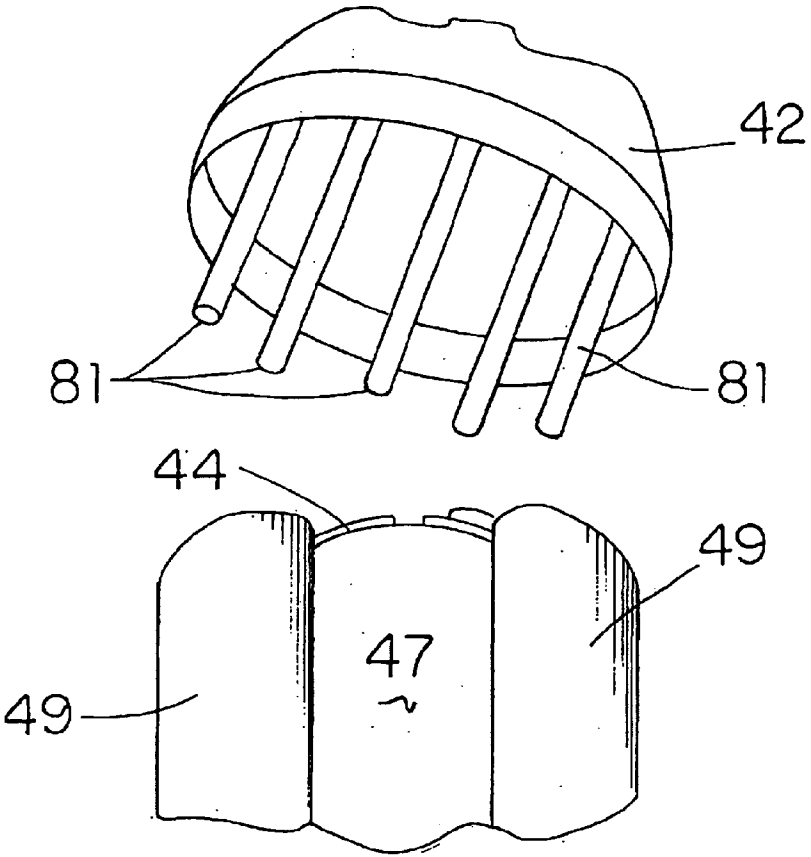
FIG. 11 is a perspective view of the top cap being installed upon the perimeter beam tower.

FIG. 11 is a perspective view of the solar base cap 42 and the swivel bracket O-ring 36, being installed atop the beam housing frame 47. A plurality of alignment pins 81 aid in securing the solar base cap 42 to the top of the beam housing frame 47.

Figure 12:
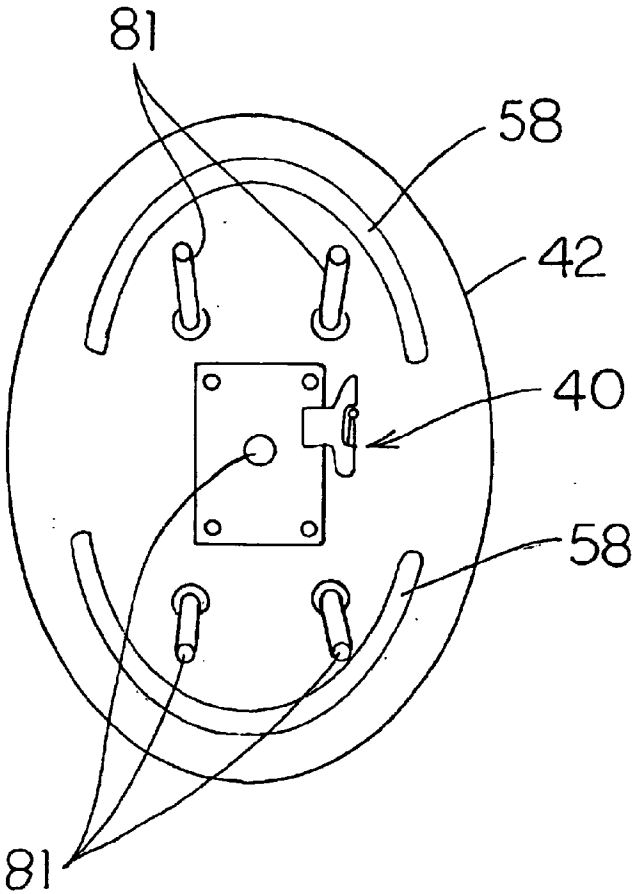
FIG. 12 is a bottom view of a solar cap and mechanism of FIG. 11.

FIG. 12 is a perspective view of the solar cap opening mechanism 40 and the solar base cap 42, as seen from the underside thereof, showing the solar cap opening mechanism 40.

Figure 13:
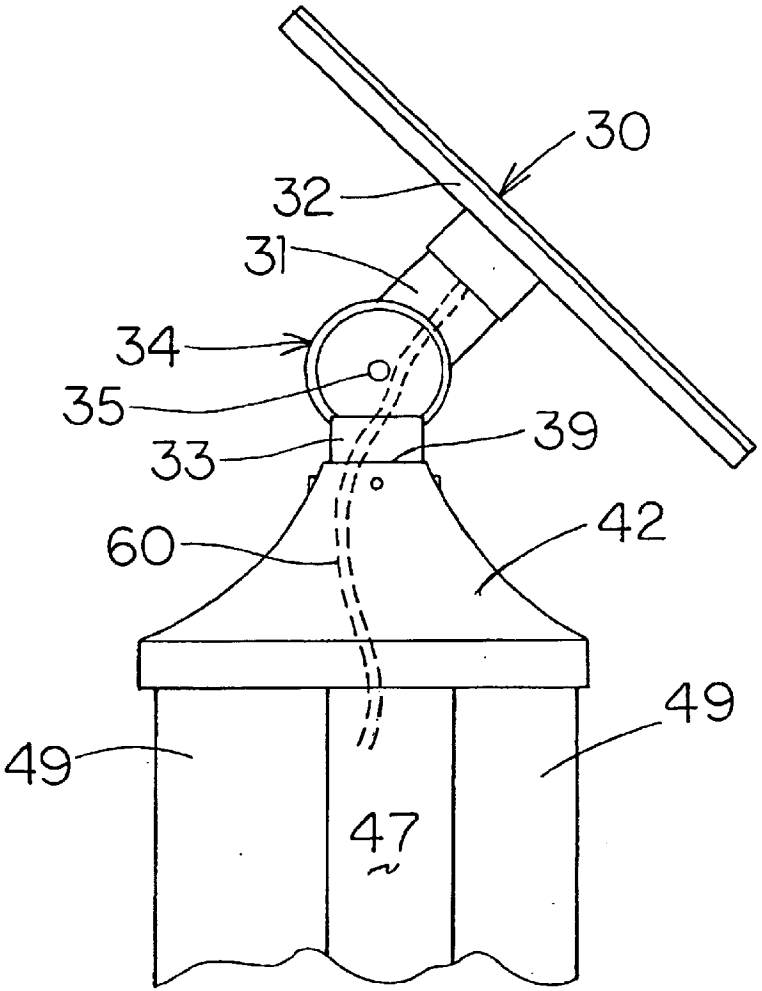
FIG. 13 is a perspective view of a solar cap, swivel bracket, and solar panel, mounted upon the solar base cap of the perimeter beam tower.

FIG. 13 is a perspective view of the solar panel 30 and solar mounting bracket 32, with the upper portion 31 of the swivel clamp 34 secured to the solar mounting bracket, and the lower portion of the swivel clamp 34 secured to the solar base cap 42. Where a solar panel 30 is not used, the top plate 44 may support a street light 200.

Figure 14:
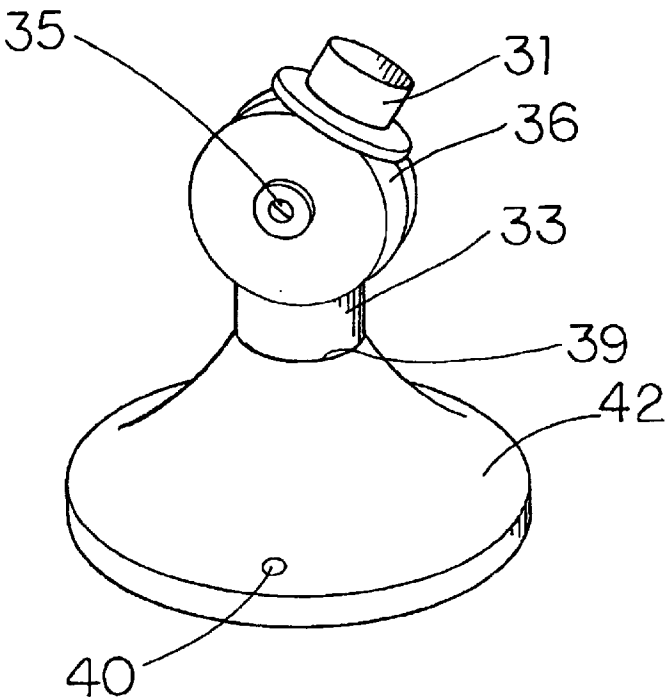
FIG. 14 is a perspective view of a swivel bracket mounted upon the solar base cap of the perimeter beam tower.

FIG. 14 is a perspective view of the swivel clamp 34 adjustably secured together with a bolt 35. A swivel O-ring 36 is positioned between the upper portion 31 and the lower portion 33 of the swivel clamp 34. A solar cap O-ring 38 is positioned between the lower portion 33 of the swivel clamp 34 and the swivel aperture 39 in the solar base cap 42.

Figure 15:
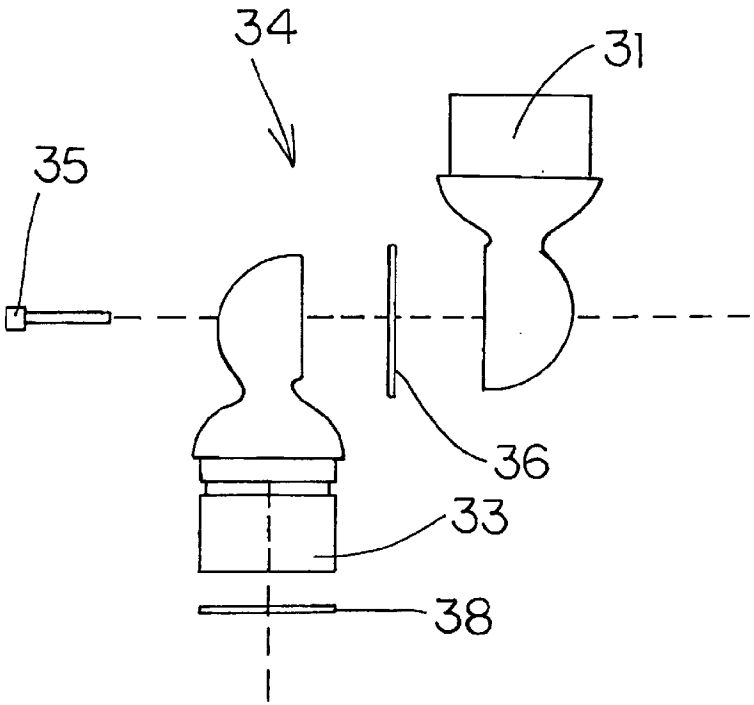
FIG. 15 is a breakaway view of a swivel bracket parts, used in the FIG. 14.

FIG. 15 is an exploded view of a swivel clamp 34 showing the upper portion 31, the lower portion 33 and the swivel O-ring 36, shown assembled in FIG. 14.

Figure 16:
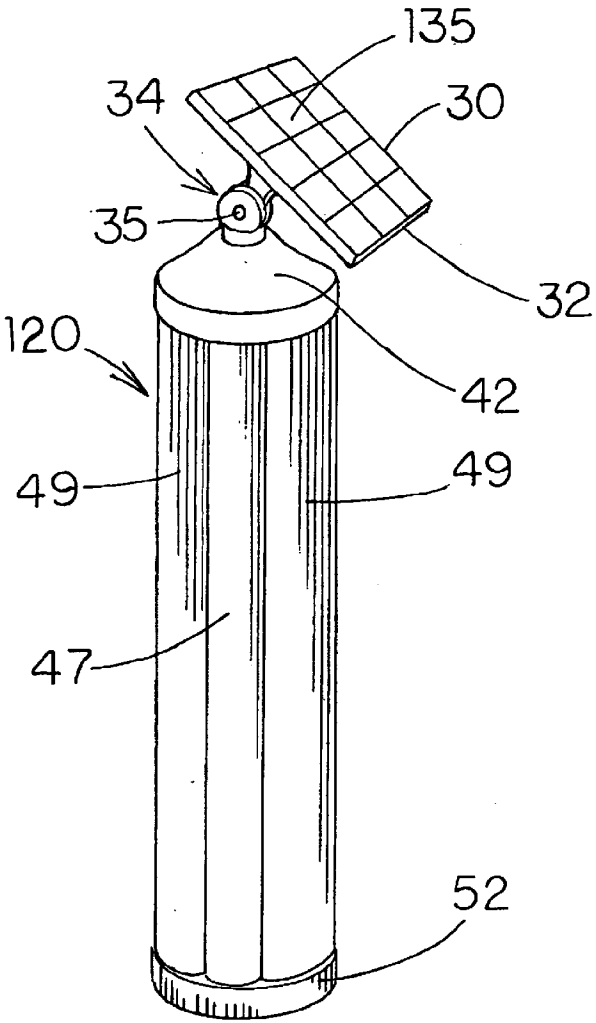
FIG. 16 is a perspective view of a complete perimeter beam tower, with a solar panel mounted upon the top plate.

FIG. 16 is a perspective view of the assembled solar tower 120, with the solar panel 30 installed.

Figure 17C:
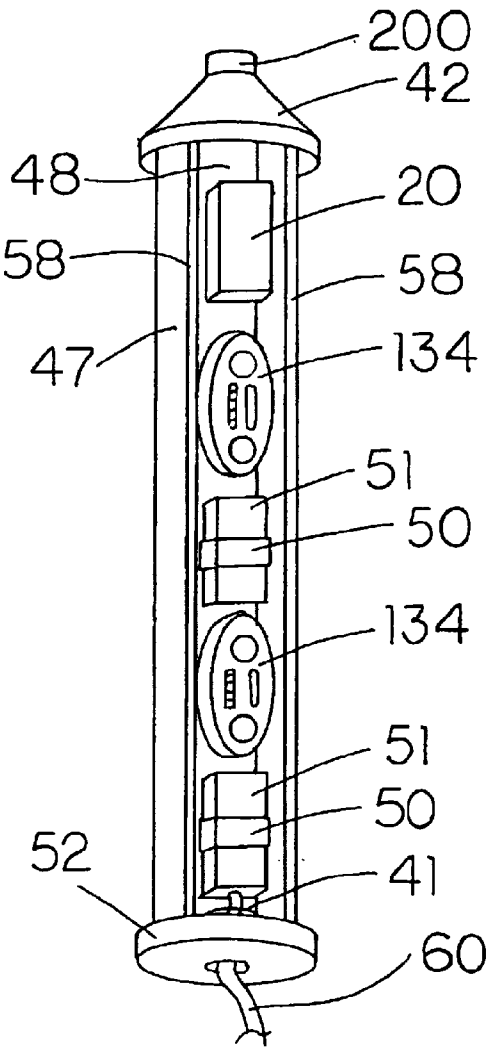
FIGS. 17A, 17B and 17C are assembled views of the perimeter beam tower, with a light mounted on the top.
Figure 17B:
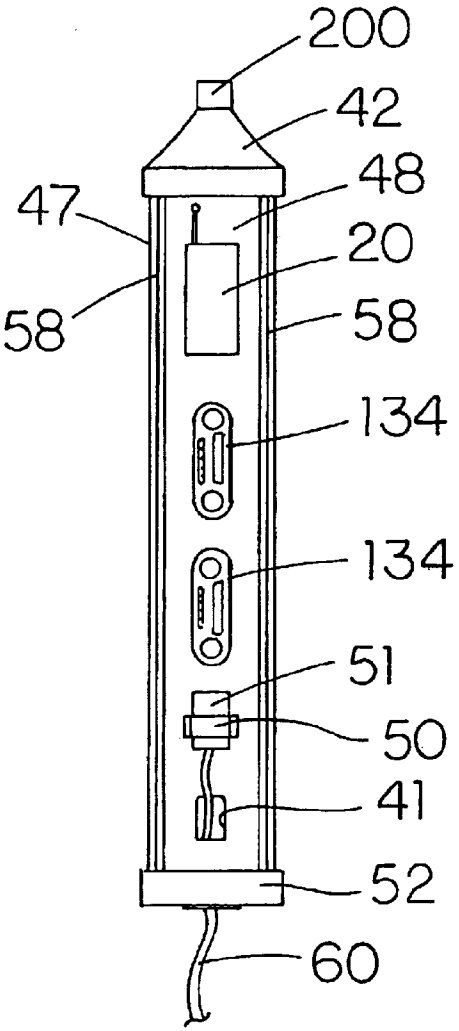
Figure 17A:
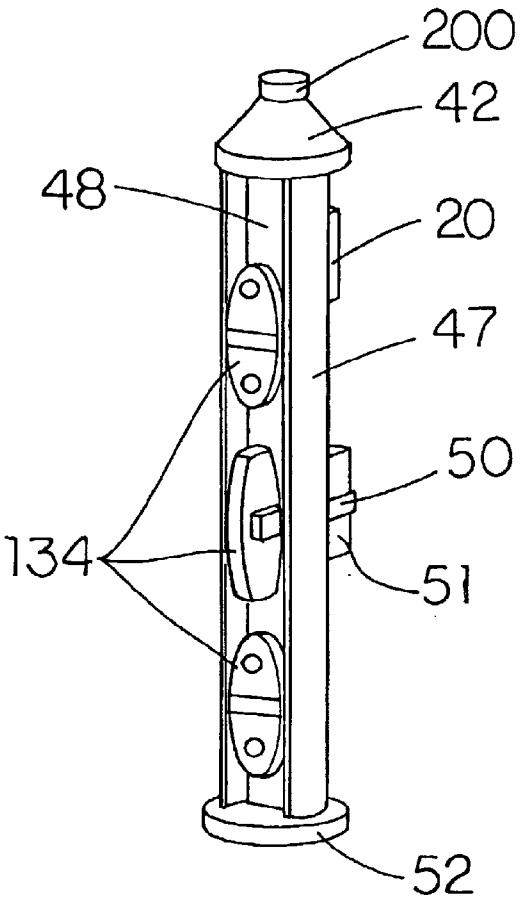

FIG. 17A, FIG. 17B and FIG. 17C are selective views of the perimeter beam tower 120 with the face shields 49 removed, showing various electronic equipment mounted upon the face 48 of the frame unit 47.

Figure 18A:
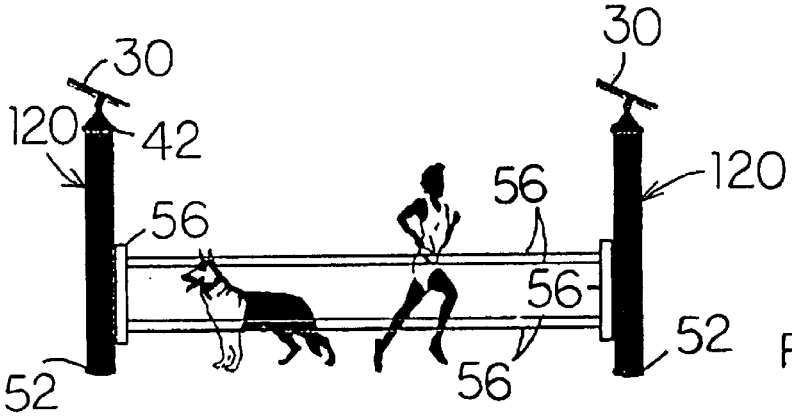
FIG. 18A is a diagram of the perimeter beam tower utilizing a point to point single quad detection beam.

FIG. 18A is a diagram showing a single quad detector beam 56 extending between adjacent perimeter beam towers 120.

Figure 18B:
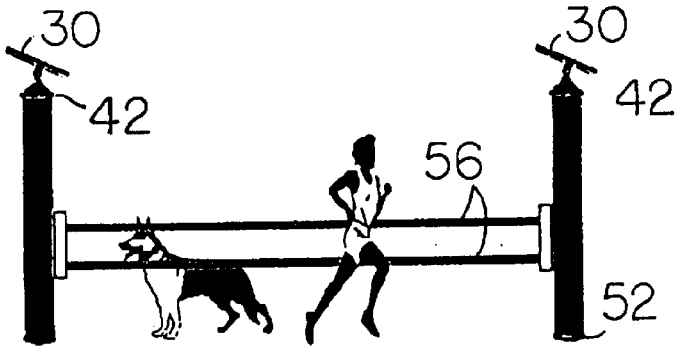
FIG. 18B is a diagram of the perimeter beam tower utilizing a point to point single dual detection beam.

FIG. 18B is a diagram showing a single dual detector beam 56 extending between adjacent perimeter beam towers 120.

Figure 18C:
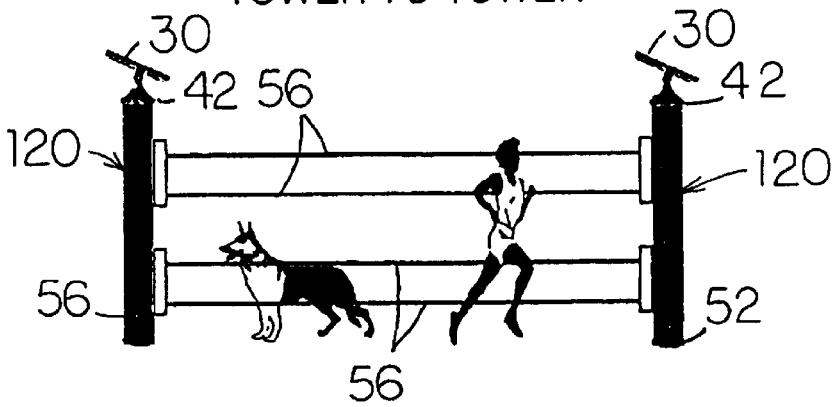
FIG. 18C is a diagram of the perimeter beam tower utilizing high/low point to point dual detection beams.

FIG. 18C is a diagram showing two dual detector beams 56 extending between adjacent perimeter beam towers 120.

Figure 18D:
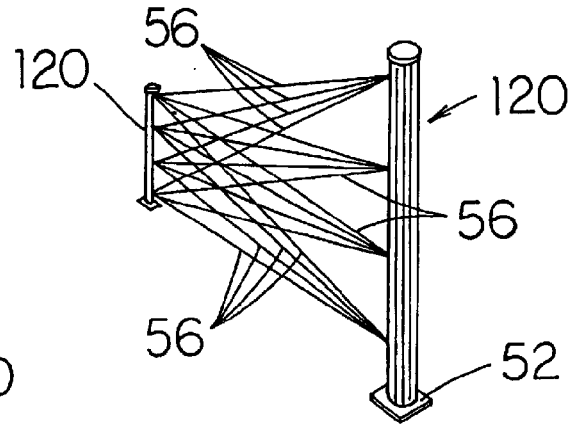
FIG. 18D is a diagram of the perimeter beam tower utilizing multiple detection beams.

FIG. 18D is a diagram showing multiple detector beams 56 extending between adjacent perimeter beam towers 120.

Figure 19:
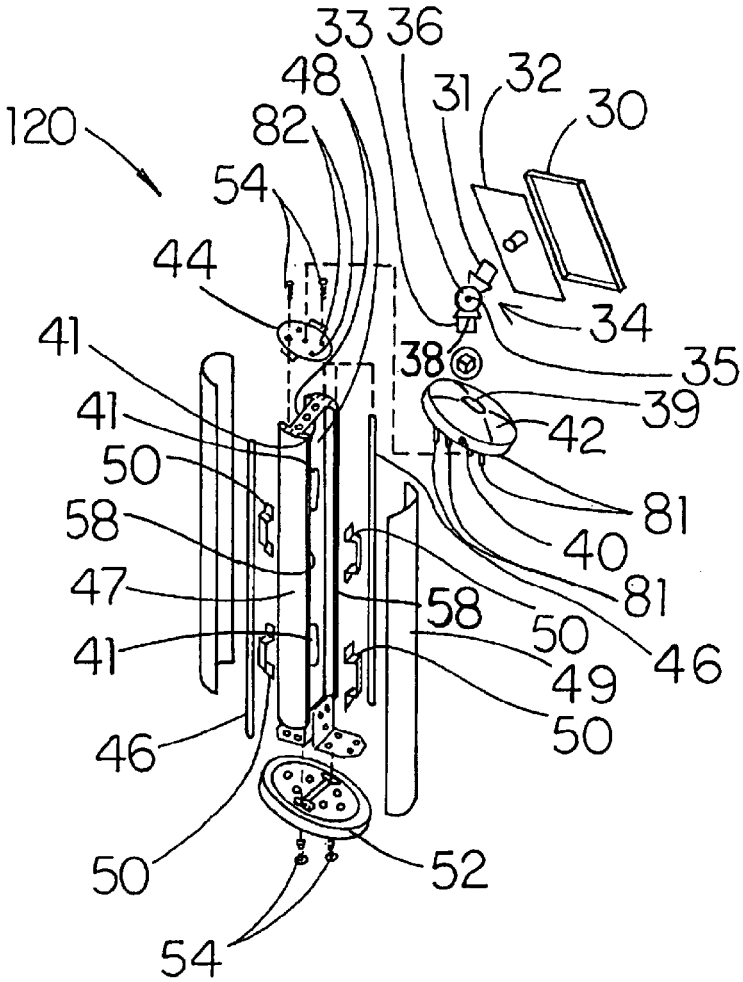
FIG. 19 is a breakaway view of the perimeter beam tower prior to assembly.

FIG. 19 is a breakaway view of the perimeter beam tower 120, with a solar panel 30 attached.

Figure 20:
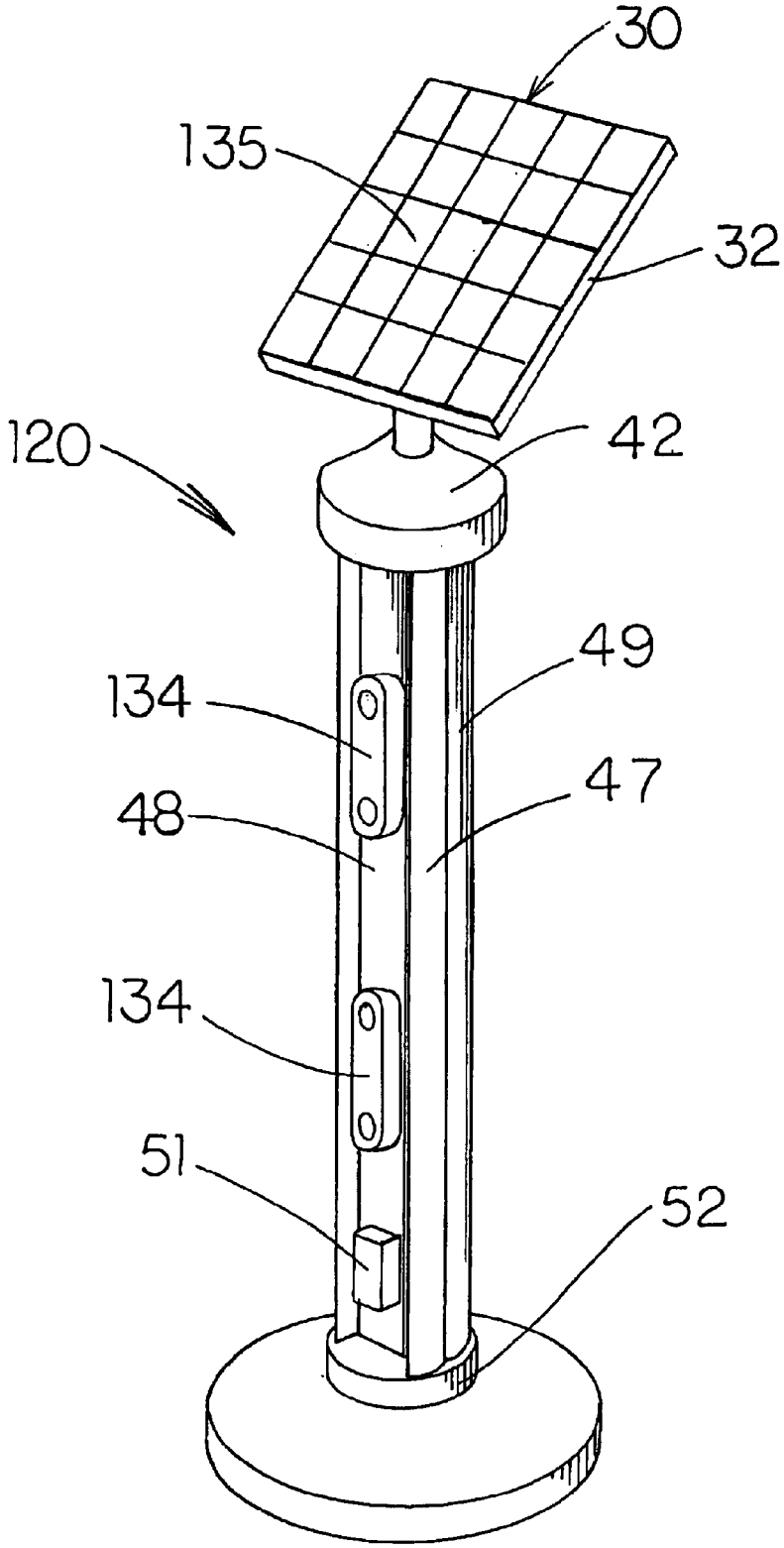
FIG. 20 is a view of the perimeter beam tower with one of the face shields removed.

FIG. 20 is a photograph showing several workers assembling a perimeter beam tower 120, wherein one of the face shields 49 has been removed to expose the electronic equipment mounted to the frame unit 47.

The invention being thus described, it will be evident that the same may be varied in many ways. Such variations are not to be regarded as a departure from the spirit and scope of the invention and all such modifications are intended to be included within the scope of the claims.

What is claimed is:

1. A perimeter beam tower for an intruder detection system having a plurality of said towers spaced apart about a perimeter and having detection beams extending therebetween for detection of an intruder, each of said towers communicating with a remote central unit, each of said towers comprising:

a) a base unit;

b) at least two support rods having upper and lower ends secured at said lower end to said base unit, and extending upwardly therefrom;

c) a top plate secured to said upper end of said support rods;

d) a frame unit having a bottom portion of a height similar to the support rods, said frame unit slidably received over said support rods, said bottom portion of the frame unit secured to the base unit, said frame unit having a face configured for mounting equipment thereto for use with the system and having opposing face shield slots extending between said base unit and said top plate;

e) opposing face shields of a height similar to the support rods, edges of each of said face shields being inserted into a respective of one of said face shield slots provided in said frame unit.

2. The perimeter beam tower of claim 1, wherein a solar base cap is secured to said top plate; a swivel clamp is mounted to said solar base cap; and a solar panel is adjustably positioned upon said swivel clamp, to enable said solar panel to be positioned at different angles to better align said solar panel with the sun.

3. The perimeter beam tower of claim 2, wherein at least one open channel is provided inside said frame unit to receive power cable wiring, said power cable wiring extending between the equipment mounted on said face and said base unit, and a solar cap opening mechanism providing access for a power cable to extend into said frame unit from said solar panel to said base unit.

4. The perimeter beam tower of claim 2, wherein said solar panel comprises a 20 watt solar panel.

5. The perimeter beam tower of claim 2, wherein said swivel clamp comprises a lower portion and an upper portion, with a swivel O-ring positioned between said upper portion and said lower portion, and said upper portion being adjustably secured to said lower portion with a suitable fastening means.

6. The perimeter beam tower of claim 1, wherein said support rods are selected to be of a height from about five feet high to about twelve feet high, and said frame unit and said opposing face shields are each of a height similar to the support rods.

7. The perimeter beam tower of claim 1, wherein said opposing face shields are shaped in a half oval configuration, and are made of a polycarbon plastic material.

8. The perimeter beam tower of claim 2, wherein a plurality of alignment pins aid in securing said solar base cap to said top plate.

9. The perimeter beam tower of claim 1, wherein at least one beam generator(s) is secured in vertically spaced alignment to said face of said frame unit, and multiple detection beams extend from one of said towers in said system to an adjacent tower in said system.

10. The perimeter beam tower of claim 9, wherein each of said towers house a receiver/processor and transmitter unit adapted for communicating with said remote central unit which is outfitted with devices configured to display information comprising the location of a breach in any of said detection beams, said information being initially communicated from the receiver/processor and transmitter unit of said tower detecting said breach.

11. The perimeter beam tower of claim 1, wherein one or more battery brackets are positioned on said face of said frame unit to support one or more batteries thereon, to provide local power.

12. A perimeter beam tower for an intruder detection system having a plurality of said towers spaced apart about a perimeter and having detection beams extending therebetween for detection of an intruder, each of said towers communicating with a remote central unit, each of said towers comprising:

a) a base unit;

b) at least two support rods having upper and lower ends being secured at said lower end to said base unit, and extending upwardly therefrom;

c) a top plate being secured to said upper end of said support rods;

d) a solar panel being mounted generally atop the tower to said base unit;

(e) a frame unit having a bottom portion of a height similar to said support rods, said frame unit being slidably received over said support rods, with said bottom portion of the frame unit being secured to said base unit, said frame unit being secured to said support rods, said frame unit comprising a face configured for mounting equipment thereto for use with the system and having opposing face shield slots extending between said base unit and said top plate, at least one open channel(s) being provided inside said frame unit to receive power cable wiring, and a solar base cap opening mechanism being provided to provide access for said power cable wiring to extend into said frame unit from said solar panel;

(f) opposing face shields of a height similar to said support rods, edges of each of said face shields being inserted into respective ones of said face shield slots provided in said frame unit;

(g) a solar base cap being secured to said top plate;

(h) a swivel clamp mounted to said solar base cap, said swivel clamp having a lower portion and an upper portion, a swivel O-ring positioned between said upper portion and lower portion, said upper portion being adjustably positioned and secured to said lower portion with a suitable fastening means; and (i) said solar panel being adjustably positioned upon said swivel clamp, to enable said solar panel to be positioned at different angles to better align said solar panel with the sun.

13. The perimeter beam tower of claim 12, wherein said solar panel comprises a 20 watt solar panel.

14. The perimeter beam tower of claim 12, wherein said support rods are selected to be of a height from about five feet high to about twelve feet high, and said frame unit and said opposing face shields are each of a height similar to said support rods.

15. The perimeter beam tower of claim 11, wherein said opposing face shields are shaped in a half oval configuration, and are made of a polycarbon plastic material.

16. The perimeter beam tower of claim 12, wherein a plurality of alignment pins aid in securing said solar base cap to said top plate.

17. The perimeter beam tower of claim 12, wherein at least one beam generator(s) is secured in spaced alignment to said face of the frame unit, and the multiple detection beams generated by the beam generators extend from one of said towers in the system to an adjacent tower in the system, each tower houses a receiver/processor and transmitter unit adapted for communicating with the remote central unit which is outfitted with devices configured to display information comprising the location of a breach of any of said detection beams, said information being initially communicated from said receiver/processor and transmitter unit of said tower detecting said breach.

18. The perimeter beam tower of claim 12, wherein one or more battery brackets are positioned on said face of the frame unit to support one or more batteries thereon.

19. A perimeter beam tower for an intruder detection system having a plurality of said towers spaced apart about a perimeter and having detection beams extending therebetween for detection of an intruder, each of said towers communicating with a remote central unit, each of said towers comprising:

a) a base unit;

b) at least two support rods having upper and lower ends being secured at said lower end to said base unit, and extending upwardly therefrom, the support rods are selected to be of a height selected from about five feet high to about twelve feet high;

c) a top plate being secured to said upper end of said support rods;

d) a solar panel being mounted generally atop the tower to said base unit;

(e) a frame unit having a bottom portion of a height similar to said support rods, said frame unit being slidably received over said support rods, with said bottom portion of the frame unit being secured to said base unit, said frame unit being secured to said support rods, said frame unit comprising a face configured for mounting equipment thereto for use with the system and having opposing face shield slots extending between said base unit and said top plate, at least one open channel(s) being provided inside said frame unit to receive power cable wiring, and a solar base cap opening mechanism being provided to provide access for said power cable wiring to extend into said frame unit from solar panel to said base unit to about said top plate;

(f) opposing face shields of a height similar to said support rods, edges of each of said face shields being inserted into respective one of said face shield slots provided in said frame unit, said opposing face shields each shaped in a half oval configuration; a light mounted upon said top plate; and (g) an electrical connection between said perimeter beam tower and a remote power supply.

20. The perimeter beam tower of claim 19, wherein at least one beam generator(s) is secured in spaced alignment to said face of said frame unit, and said detection beams generated by said beam generator(s) extend from one of said towers in the system to an adjacent tower in the system, each of said towers housing a receiver/processor and transmitter unit adapted for communicating with said remote central unit which is outfitted with devices configured to display information comprising the location of a breach in any of said detection beams, said information being initially communicated from said receiver/processor and transmitter unit of the tower detecting said breach.

* * * * *